US005357174A

United States Patent [19]

Nerone et al.

[11] Patent Number: 5,357,174

[45] Date of Patent: Oct. 18, 1994

[54] FEEDBACK-CONTROLLED CIRCUIT AND METHOD FOR POWERING A HIGH INTENSITY DISCHARGE LAMP

[75] Inventors: Louis R. Nerone, Brecksville; David J. Kachmarik, North Olmsted, both of Ohio

[73] Assignee: General Electric Company, Schenectady, N.Y.

[21] Appl. No.: 971,791

[22] Filed: Nov. 5, 1992

[51] Int. Cl.[5] ..... H05B 37/02

[52] U.S. Cl. ..... 315/224; 315/209 R; 315/307; 315/DIG. 7

[58] Field of Search ..... 315/244, 209 R, 307, 315/291, 199, DIG. 5, DIG. 7; 363/37, 89, 90

[56] References Cited

U.S. PATENT DOCUMENTS 4,928,038 5/1990 Nerone ..... 315/209 R
5,128,592 7/1992 Dean et al. ..... 315/224

FOREIGN PATENT DOCUMENTS 62305992 1/1990 Japan ..... 363/89

*Primary Examiner*—Robert J. Pascal
*Assistant Examiner*—Haissa Philogene
*Attorney, Agent, or Firm*—George E. Hawranko; Stanley C. Corwin

[57] ABSTRACT

A circuit and method for powering a high intensity discharge lamp, such as a high pressure sodium lamp (HPSL) are disclosed. Feedback control is used to achieve a nearly constant amplitude of lamp current so as to attain nearly constant lamp color in a HPSL, and further accommodates considerable variations in a.c. line voltage. The circuit, which shares some features with the method, includes a circuit to supply a d.c. bus voltage and first and second feedback-controlled circuits. The first feedback controlled circuit regulates the bus voltage in response to a first error signal which is derived as a function of peak lamp current and a set point signal for such peak current. The second feedback controlled circuit regulates lamp power in response to a second error signal which is derived as a function of average bus current and a set point proportional to the difference between regulated bus voltage and lamp power.

19 Claims, 4 Drawing Sheets

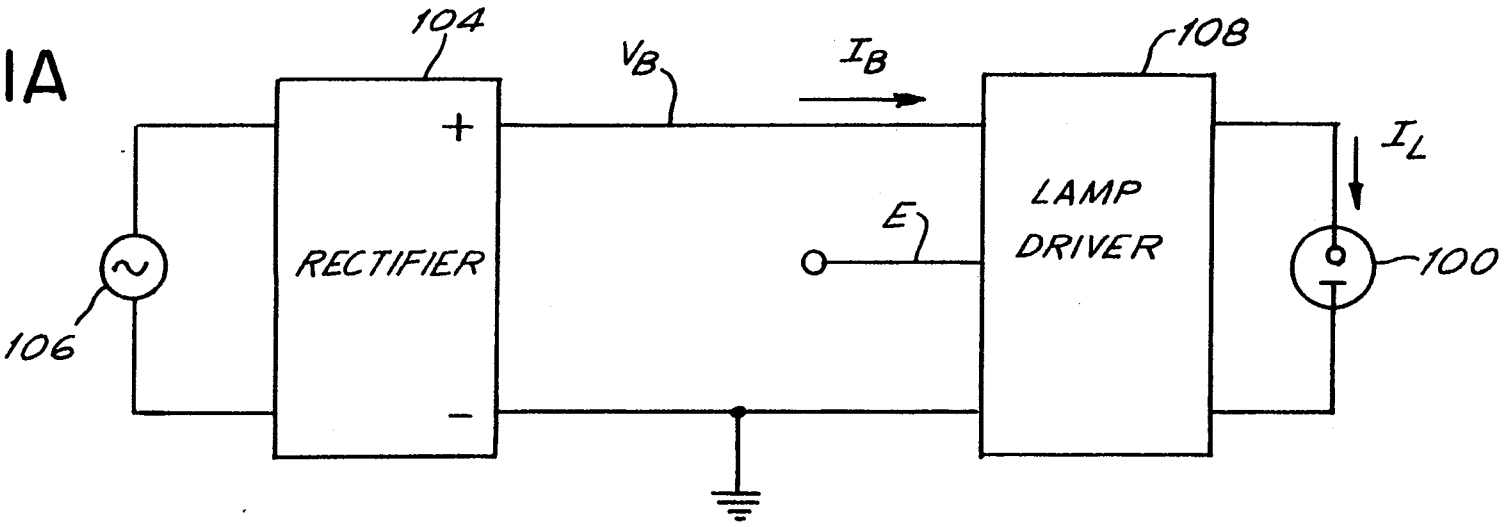
FIG. IA (PRIOR ART)
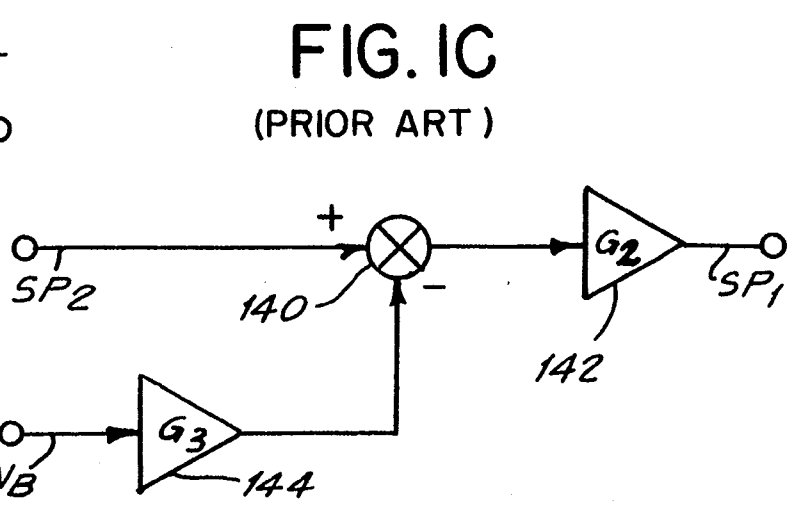
FIG. IC (PRIOR ART)
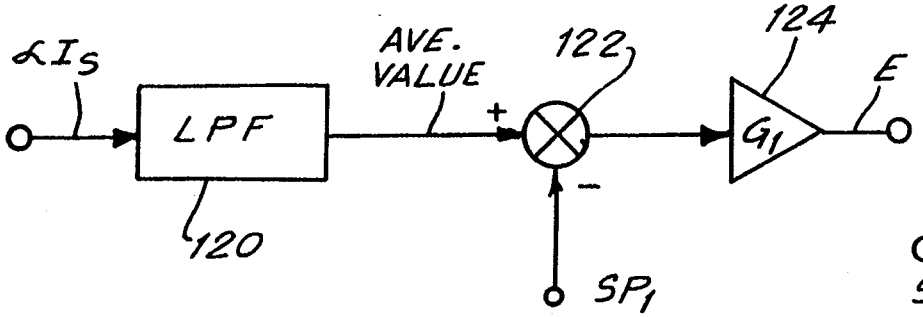
FIG. IB (PRIOR ART)

FEEDBACK-CONTROLLED CIRCUIT AND METHOD FOR POWERING A HIGH INTENSITY DISCHARGE LAMP

CROSS-REFERENCE TO RELATED APPLICATION

This application is related to the commonly owned, copending applications entitled "Circuit And Method For Operating High Pressure Sodium Vapor Lamps," applicant docket no. LD-10,203, filed (Ser. No. 07/971,806) concurrently herewith, by Kachmarik et al and "High-Pressure Sodium Lamp Control Circuit Providing Constant Peak Current And Color", (Ser. No. 07/972,036) applicant docket number LD 10,265, filed concurrently herewith by Kachmarik et al. The entire disclosure of such related application is incorporated herein by reference.

1. Field of the Invention

The present invention relates to the field of power supplies for high intensity discharge lamps, and more particularly to power supplies using feedback control for regulating voltage or current supplied to a lamp.

2. Background of the Invention

A high pressure sodium lamp (HPSL) is one example of a high intensity discharge lamp that can benefit from the instant invention; other examples include quartz lamps. High pressure sodium lamps (HPSLs) have been in wide use for years, especially for exterior lighting applications such as floodlighting and road lighting. One problem with HPSLs is the considerable drift in lamp impedance that normally occurs as the lamp ages. Such impedance drift is due to such factors as outgassing of the active lamp element sodium into an arc tube that houses the sodium. The drift in impedance value is upwards, causing a lamp with increasing usage to require increasingly greater power, eventually exceeding the capacity of its power supply circuit, and resulting in lamp failure.

Variations in impedance from lamp to lamp also occur from usual manufacturing tolerances. Using the same lamp driving voltage, for instance, such impedance variations cause variations amongst lamps in both lumen output and spectrum of light wavelengths emitted (i.e., the color of light produced). Similar variations in lamp characteristics can also result from changes in line voltages for even the same lamp.

One approach to alleviating the foregoing problems is disclosed in commonly owned U.S. Pat. No. 4,928,038 to L. Nerone, one of the instant inventors. The '038 patent employs a power switch that applies a d.c. bus, or compliance, voltage across the series combination of lamp and a driver, or ballast, inductor when the switch is on, or conducting. When the switch is off, or non-conducting, the lamp is isolated from the bus voltage, and lamp current is then controlled by the impedance of the driver inductor and the internal lamp impedance. The average current through the power switch is measured, and in a feedback Iccp, an "error" signal is generated that essentially represents the difference between the average switch current and a set point for the current. The error signal is then used to control the on-off operation of the power switch so as to minimize the error signal. The set point itself may be dynamic, and responsive to variations in the d.c. bus voltage caused by variations of line voltage of an a.c. supply.

The approach of the '038 patent has produced distinct advantages over previous circuits for powering HPSLs, especially in regard to compensating for considerable variations in a.c. line voltage. However, further improvement in lamp performance would be desirable, especially in the ability to compensate for considerable changes in lamp impedance from lamp to lamp, or as a lamp ages.

It would further be desirable to provide a constant-amplitude driving current for a high intensity discharge lamp, which has been found in HPSLs to achieve reproducible color output.

SUMMARY OF THE INVENTION

Accordingly, an object of the invention is to provide a feedback-controlled circuit and method for powering a high intensity discharge lamp that achieves a desired power level in the lamp despite considerable changes in the value of lamp impedance.

Another object of the invention is to provide a feedback-controlled circuit and method of the foregoing type that also achieves a nearly constant amplitude of driving current for the lamp.

A further object is to provide circuits and methods of the foregoing several types that can be implemented with low cost, readily available circuit components.

The foregoing objects are realized by a circuit and method for powering a high intensity discharge lamp. The circuit includes a means for supplying a d.c. bus voltage, and first and second feedback-controlled means. The first feedback-controlled means regulates on a conductor supplying bus current the bus voltage in response to a first error signal in such manner as to minimize the first error signal. The first error signal is substantially proportional to the difference between (1) a dynamic signal substantially proportional to peak bus current and (2) a set point signal for peak lamp current. The second feedback-controlled means drives the lamp with the regulated bus voltage in response to a second error signal in such manner as to minimize the second error signal and thereby regulate power in the lamp. The second error signal is substantially proportional to the difference between (1) a dynamic signal substantially proportional to average bus current and (2) a dynamic set point signal which is substantially proportional to the difference between (i) a dynamic signal substantially proportional to the regulated bus voltage and (ii) a set point signal relating to lamp power.

The method includes the steps of supplying a d.c. bus voltage and regulating on a conductor supplying bus current, the bus voltage in response to a first error signal in such manner as to minimize the first error signal. The first error signal is substantially proportional to difference between (1) a dynamic signal substantially proportional to peak lamp current and (2) a set point signal for peak lamp current. The method further includes the step of driving the lamp with the regulated bus voltage in response to a second error signal in such manner as to minimize the second error signal and thereby regulate power in the lamp. The second error signal is substantially proportional to the difference between (1) a dynamic signal substantially proportional to average bus current and (2) a dynamic set point signal substantially proportional to the difference between (i) a dynamic signal substantially proportional to the regulated bus voltage and (ii) a set point signal relating to lamp power.

The above-described objects and further advantages of the invention will become apparent from the following description taken together with the accompanying drawings.

BRIEF DESCRIPTION OF THE DRAWINGS

In the following detailed description of the invention, reference will be made to the attached drawings in which:

FIG. 1A is a schematic diagram partly in block form representing a prior art electrical circuit for regulating lamp power, and FIGS. 1B and 1C are circuit diagrams partly in block form of portions of a feedback loop used with the circuit of FIG. 1A.

DESCRIPTION OF THE PREFERRED EMBODIMENTS

Figures 2A, 2B, 2C:
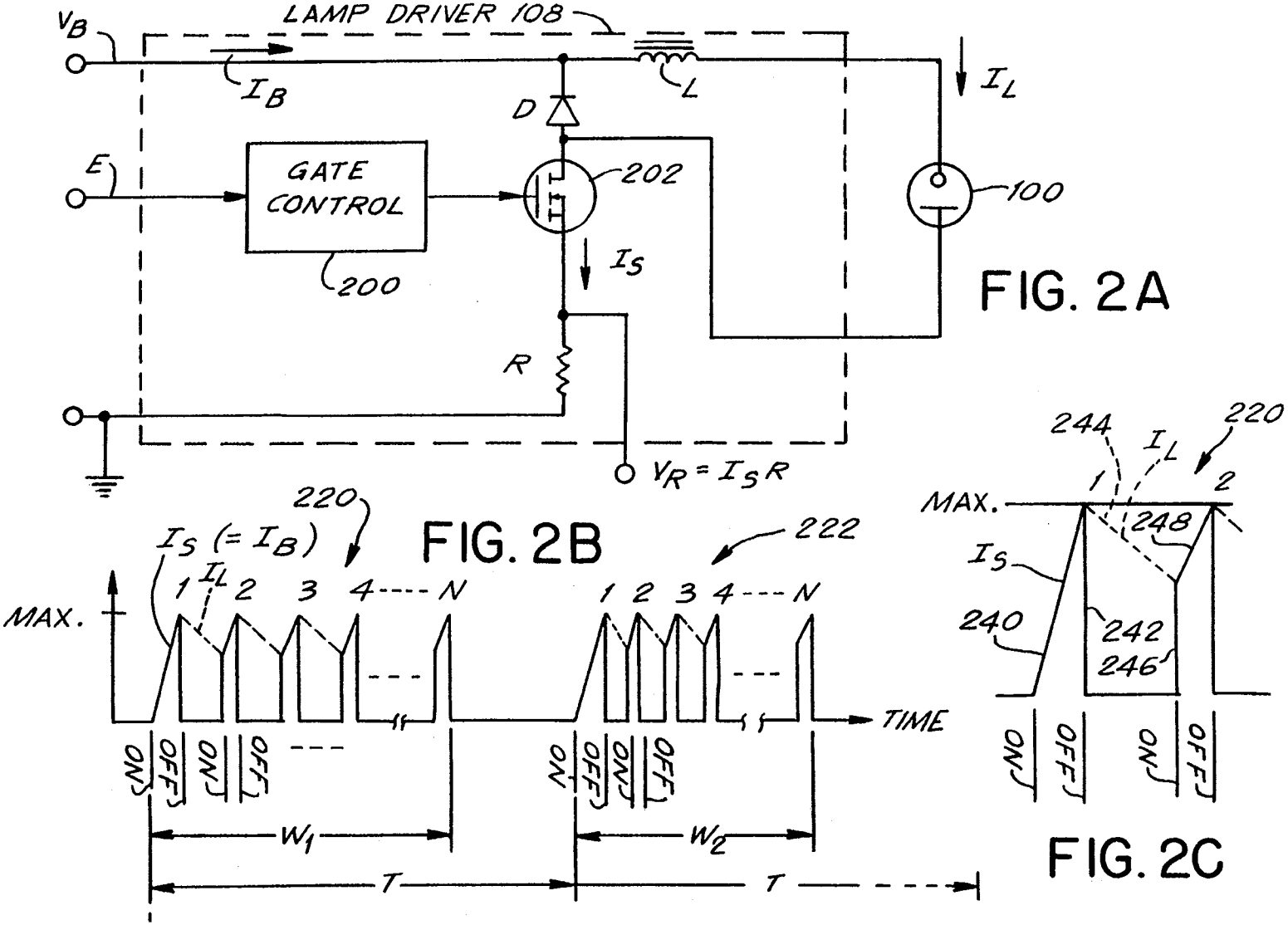
FIG. 2A is a detail schematic diagram of a lamp driver circuit shown in block form in FIG. 1A, and FIGS. 2B and 2C show waveforms of various currents in the circuit of FIG. 2A.

To facilitate understanding of the instant invention, the prior art approach of the above-mentioned U.S. Pat. No. 4,928,038 for regulating power supplied to a high pressure sodium lamp is first described, in connection with the instant "Prior Art" FIGS. 1A–1C.

FIG. 1A shows a simplified schematic of a circuit for powering a high intensity discharge lamp 100, such as a high pressure sodium lamp (HPSL). A bus voltage $V_B$, also known as the link, or compliance, voltage comprises the d.c. output voltage of a full-wave bridge rectifier 104, whose current output is $I_B$. Rectifier 104 is supplied with a.c. power by source 106. A standard power correction circuit (not shown) may be placed in the current path between rectifier 104 and a.c. source 106. A lamp driver circuit 108, supplied with the bus voltage $V_B$ and bus current $I_B$, "drives" lamp 100 with suitable voltage or current waveforms, as described below, for regulating lamp power towards a constant value.

Lamp driver 108 is controlled by a feedback error signal E, produced by the feedback Iccp shown in FIG. 1B. In that figure, a low pass filter 120 receives signal $\alpha I_S$ proportional to a current $I_S$ described below, where $\alpha$ indicates proportionality. Low pass filter 120 outputs a time-averaged value of $\alpha I_S$ to the positive input of a standard summing amplifier 122. The negative input of the summing amplifier is fed with a target value, or set point, $SP_1$ for average current, which may be non-dynamic. The output of the summing amplifier 122, scaled by a gain $G_1$ of an amplifier 124, constitutes the error signal E to which lamp driver 108 responds to regulate the average lamp power towards a constant value.

FIG. 1C shows an enhancement to the feedback Iccp of FIG. 1B to compensate for variations in the d.c. bus voltage $V_B$ caused by variations in the line voltage of the a.c. source 106 (FIG. 1A). The FIG. 1C circuit makes the set point $SP_1$, used in feedback loop 120 of FIG. 1B, a dynamic signal. In FIG. 1C, the signal $SP_1$ is the output of a standard summing amplifier 140 as scaled by gain $G_2$ of an amplifier 142. The positive input of summing amplifier 140 is a non-dynamic set point $SP_2$, and its negative input is the bus voltage $V_B$ as scaled by gain $G_3$ of amplifier 144.

Further details of lamp driver 108 (FIG. 1A) are shown in the detail view of FIG. 2A. As will become apparent below, the circuit of FIG. 2A can comprise part of an inventive combination of elements, and for this reason FIG. 2A and associated FIGS. 2B and 2C are not labelled Prior Art.

AS shown in FIG. 2A, error signal E is received by a gate control circuit 200 for controlling the on (conducting) and off (non-conducting) states of a power field-effect transistor (FET), or other power switch, 202 of lamp driver 108. Assuming the lamp current $I_L$ is initially zero, turning power switch 202 on grounds the lower terminal of lamp 100 via resistor R, and impresses the full bus voltage $V_B$ across the lamp terminals since the initial voltage in inductor L is zero. Diode D initially is non-conducting. Turning switch 202 off causes diode D to conduct the lamp current $I_L$, which then decays though inductor L. The current in power switch 202, i.e., current $I_S$, is common with, or the same as, the bus current $I_B$ when diode D is non-conducting, and both are zero when switch 202 is off and diode D conducts. Thus, the switch current $I_S$ and the bus current $I_B$ are the same in the circuit shown.

The switch current $I_S$ (and hence the bus current $I_B$) is measured by means of resistor R, through which switch current $I_S$ flows. The voltage $V_R$ impressed on the upper terminal of resistor R is proportional to the switch current $I_S$ by the known relationship that $V=IR$. The voltage $V_R$ is the signal $\alpha I_S$ that is applied to low pass filter 120 of FIG. 1B.

Gate control circuit 200 (FIG. 2A) controls the on and off operation of switch 202 to create the current waveforms shown in FIG. 2B. In that figure, the solid-line curve represents switch current $I_S$, and comprises a series of N trapezoidal pulses 220 in a duty cycle period T that is constant, followed by another series of N pulses 222 in a succeeding duty cycle period, also T. Below the time axis are shown the on and off timing cycles for the switch 202.

The first two pulses of pulse series 220 are shown in the detail view of FIG. 2C. As that figure shows, when switch 202 is turned on, the first pulse in series 220 ramps from zero to a preset maximum value (curve 240), during which time the switch current is common with, or the same as, the lamp current $I_L$. When a maximum current value is reached, switch 202 is turned off, causing the switch current $I_S$ to fall rapidly to zero (curve 242). The lamp current $I_L$, however, decays through inductor L (FIG. 2A) via diode D, and follows the sloping, dashed-line curve 244, also marked as "$I_L$." When switch 202 is again turned on, the switch current $I_S$ rises rapidly along curve 246, and then, together with the then-common lamp current $I_L$, ramps along curve 248 to the maximum value. Switch 202 is cyclically operated in this manner to create series 220 of N pulses.

FIG. 2B shows the next series of pulses 222, also comprising N in number, but occurring in a shorter time interval $W_2$ than interval $W_1$ of the first series 220. Achieving the shorter interval $W_2$ results from switching switch 202 at a higher frequency during pulse series 222 than during series 220. Because the lengths of intervals $W_1$, $W_2$, etc. constitute the active portions of a constant-period (T) duty cycle for driving the lamp, adjusting the lengths of such intervals $W_1$, $W_2$, etc. regulates the average current in the lamp.

Further details of lamp driver 108 of FIG. 2A, and especially of gate control circuit 200, are disclosed in the subject prior art '038 patent, particularly in relation to FIG. 3 of that patent.

Mathematical Analysis of the Feedback Loop of the '038 Patent

Referring again to FIG. 2A, regulation of the lamp power towards a constant value is achieved in the manner so far described for controlling the on-off operation of power switch 202. Thus, using the terminology of this application, the '038 patent (e.g., cols. 3–4) teaches that lamp power is essentially proportional to the mathematical product of the d.c. bus voltage $V_B$, assumed constant for mathematical analysis, and the dynamic average value of switch current $I_S$ (FIG. 2A). This may be represented mathematically as follows:

$$P_L \alpha V_B(\text{AVE. } I_S), \qquad \text{(eq. 1)}$$

where $P_L$ is lamp power, $\alpha$ indicates proportionality, $V_B$ is bus voltage, and AVE. $I_B$ is the average current in switch 202 (FIG. 2A).

According to equation 1, regulating the average switch current $I_S$ (or the common bus current $I_B$) towards a constant value tends to achieve constant lamp power.

It has, however, been discovered that while the approach of the foregoing-described '038 patent has produced a distinct improvement in lamp performance, further improvement would be desirable. For instance, the instant invention regulates lamp power in a way that more fully compensates for the increasing impedance over time of a lamp, such as a HPSL.

Figures 3A, 3B, 3C:
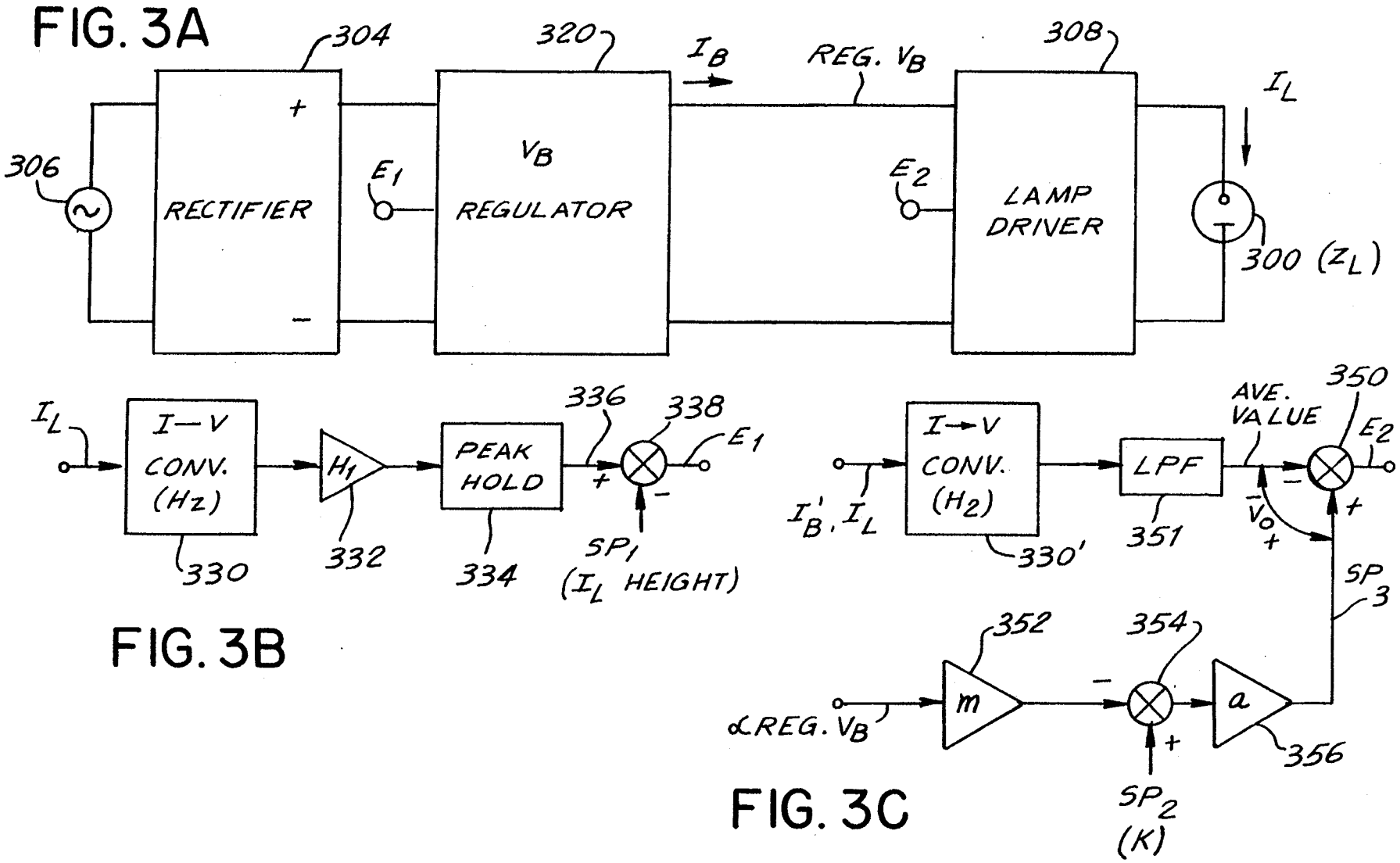
FIG. 3A is a schematic diagram partly in block form of an electrical circuit for powering a lamp in accordance with the invention.
FIGS. 3B and 3C are respective circuit diagrams partly in block form of a pair of feedback loops used with the circuit of FIG. 3A.

In accordance with the invention, FIGS. 3A–3C show a circuit for regulating power of a high intensity discharge lamp 300, such as a high pressure sodium lamp (HPSL). A full-wave bridge rectifier 304 translates a.c. voltage from a.c. source 306 to a d.c. voltage appearing across the "+" and "−" output terminals of the rectifier. Interposed between the d.c. output of rectifier 304 and a lamp driver 308, in contrast with prior art FIG. 1A, is a bus voltage, or $V_B$, regulator 320, which provides bus current $I_B$ and regulates the value of the bus voltage $V_B$ and thereby, as shown below, the peak value of lamp current. It is known that for an HPS lamp, a substantially uniform lamp color is highly desirable and to achieve this uniformity, the peak lamp current plays an important role; accordingly, regulation of this current value strongly affects lamp color in a HPSL. $V_B$ regulator 320, moreover, is feedback controlled by an error signal $E_1$, which is distinct from error signal $E_2$ supplied to lamp driver 308.

Referring to FIG. 3B, showing a feedback loop for producing error signal $E_1$, the lamp current $I_L$ commences the loop. A current-to-voltage converter 330 includes a transformer 400, shown in FIG. 4A, which conducts on its primary winding the lamp current $I_L$ and on its secondary winding, a current $\alpha I_L$, where $\alpha$ indicates the proportionality of the secondary-to-primary winding turns ratio of the transformer. Current-to-voltage converter 330 produces an output with a conversion gain $H_2$, which incorporates the mentioned winding turns ratio. The output of converter 330, in turn, is further scaled by gain $H_1$ of amplifier 332 before reaching a peak-hold circuit 334. The output of the peak-hold circuit on line 336, which output is proportional to the peak value of the lamp current $I_L$, has subtracted from it at a standard summing amplifier 338 a set point value $SP_1$, to produce error signal $E_1$ as the output of the summing amplifier.

Figures 4A, 4B, 5:
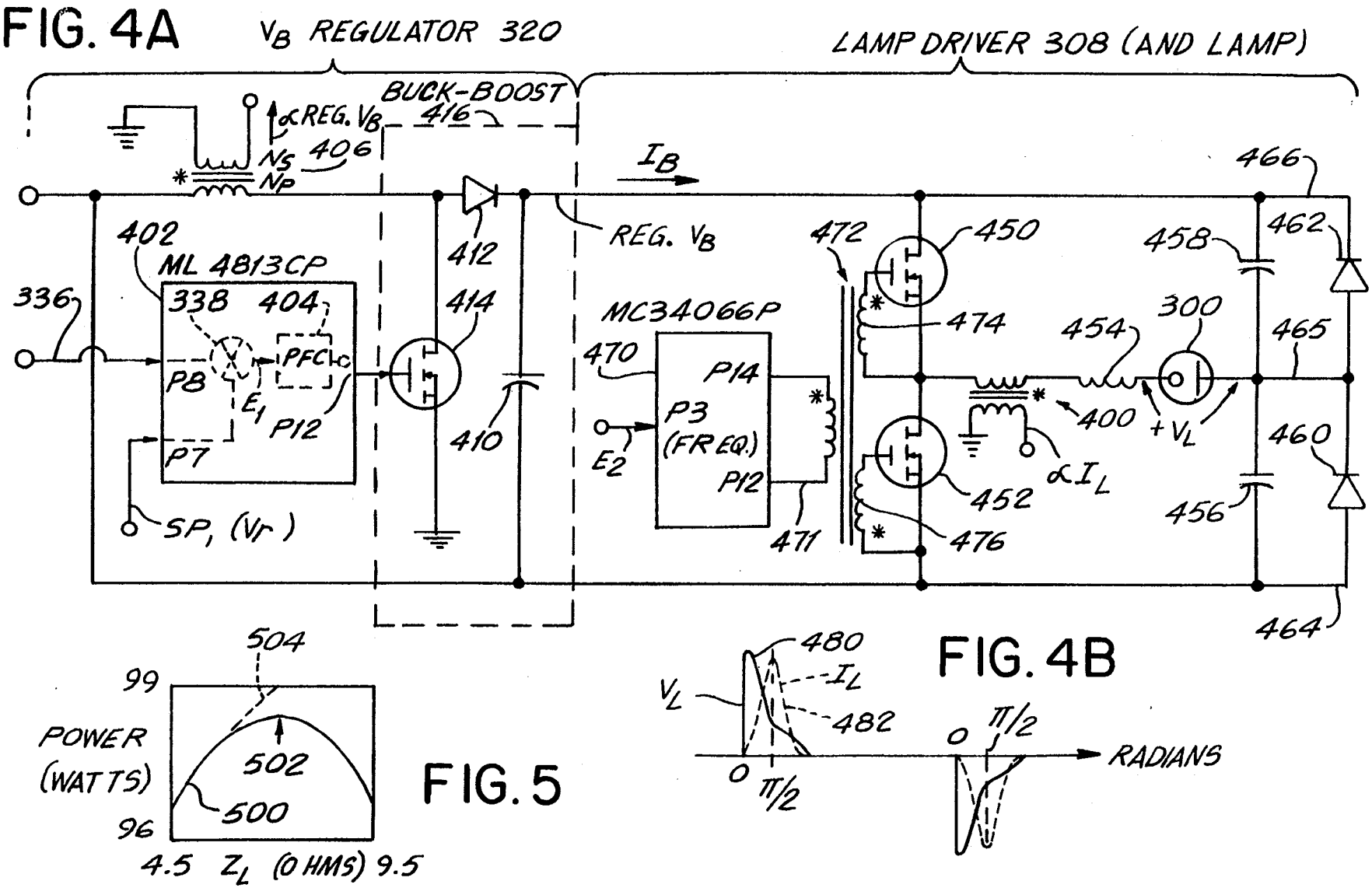
FIG. 4A is a detail schematic diagram of a bus-voltage regulating circuit and a lamp-driver circuit shown in block form in FIG. 3A.
FIG. 4B shows waveforms of current and voltage from the lamp driver circuit of FIG. 4A.
FIG. 5 is a graph of lamp power versus lamp impedance for an embodiment of the invention.

$V_B$ regulator 320 (FIG. 3A), which responds to error signal $E_1$, is shown in more detail in FIG. 4A. As shown in that figure, $V_B$ regulator 320 may utilize a standard ML4813CP integrated circuit (IC) 402, which is assumed for the following description. With IC 402 as specified, summing amplifier 338 of the feedback loop of FIG. 3B is internal to the IC. Thus, pin 8 of IC 402 corresponds to line 336 shown in FIG. 3B, and pin 7 of the IC corresponds to the negative input to summing amplifier 338 (FIG. 3B). The set point $SP_1$ is conveniently provided on pin 7 of IC 402 by a reference voltage $V_r$, which may be non-dynamic. IC 402 typically further includes a standard power factor control circuit 404, responsive to the error signal $E_1$ and whose output represents a modified error signal used in IC 402 for controlling the duty cycle, or on-off operation, of a power switch 414. Power factor control of 0.99 has been attained in this manner.

Secondary current flowing through a transformer 406 indirectly indicates the regulated bus voltage REG. $V_B$, such secondary current being substantially proportional to such voltage. This is because the amount of current charges "pumped" into capacitor 410 via diode 412 and transformer 406 when switch 414 is off determines the value of the regulated bus voltage REG. $V_B$ on capacitor 410. The timing of on and off operation of switch 414, determined by the output of IC 402 on pin 12, thus controls the value of the regulated bus voltage REG. $V_B$. Together, capacitor 410, diode 412 and switch 414 comprise a buck-boost circuit 416 of standard construction for regulating the regulated bus voltage REG. $V_B$ as needed and which, if necessary, causes REG. $V_B$ to rise above the d.c. bus voltage supplied by rectifier 304 (FIG. 3A).

$V_B$ regulator 320 provides a regulated bus voltage REG. $V_B$ that is nearly constant in contrast to the frequency of operation of the succeeding-stage lamp driver 308. As described below, the provision of the regulated bus voltage REG. $V_B$ results in a nearly constant amplitude of current used to drive lamp 300. In a HPSL, this results in lamp 300 consistently exhibiting a desired color spectrum. Additionally, $V_B$ regulator 320 compensates for considerable changes in the line voltage of a.c. supply 306.

FIG. 3C shows a feedback Iccp used to produce error signal $E_2$, to which lamp driver 308 of FIG. 3A is responsive. In FIG. 3C, a standard summing amplifier 350 receives its negative input from a feedback branch that receives a signal $I_B'$ as the input to a current-to-voltage converter 330'. The average value of signal $I_B'$ at least approximates the average bus current $I_B$. The output of converter 330' represents the signal $I_B'$ scaled by conversion gain $H_2$ of the converter. A low pass filter 351 then time averages the output of converter 330', providing the averaged value to the negative input of summing amplifier 350.

By way of example, signal $I_B'$ received by current-to-voltage converter 330' may be the bus current $I_B$, which, in the FIG. 2A embodiment, is common with the switch current $I_S$. Signal $I_B'$ may also be the lamp current $I_L$, whose average value approximates the average value of the bus current $I_B$. If the lamp current $I_L$ is input into converter 330', converter 330 of FIG. 3B can be the same as converter 330'.

The input of an amplifier 352 is substantially proportional to the regulated bus voltage REG. $V_B$, and may comprise the secondary winding current from transformer 406 (FIG. 4A), which, as described above, indirectly indicates the regulated bus voltage REG. $V_B$. The secondary winding current of transformer 406, specifically, is substantially proportional to $(N_S/N_P)$(REG. $V_B$), where REG. $V_B$ is the regulated bus voltage and $N_S/N_P$ is the secondary-to-primary turns ratio of transformer 406. Amplifier 352 is preferably configured to receive its input current from transformer 406 through an input resistor (not shown) connected to the negative input of an operational amplifier (not shown), which input, in turn, is connected to the output of such amplifier through a feedback resistor (not shown). The gain m of amplifier 352 is then the ratio of the feedback resistance divided by the input resistance. The positive input of such operational amplifier may then be connected to pins 5 and 15 (not shown) of an IC 470 comprising a MC34066P chip, as described below. The output of amplifier 352 is (REG. $V_B$)$(N_S/N_P)$m, where m is the gain of amplifier 352; such output is applied as a negative input to a standard summing amplifier 354.

The positive input of amplifier 354 is a set point $SP_2$, which may be non-dynamic. The value of set point $SP_2$ is referred to herein as K, and may be non-dynamic. The output of summing amplifier 354 is scaled by gain a in amplifier 356 to produce a dynamic set point $SP_3$, which is applied as the positive input to summing amplifier 350. The output of amplifier 350 is the error signal $E_2$. A so-called offset voltage $V_O$, whose value may be positive or negative, typically exists between the positive and negative inputs of amplifier 350. Both set points $SP_2$ and $SP_3$ in the feedback loop of FIG. 3C significantly affect lamp power.

Mathematical Analysis of Inventive Feedback Loops

A mathematical analysis of the feedback loops shown in FIGS. 3B and 3C shows, for instance, their ability to compensate for considerable changes in the impedance $Z_L$ of lamp 300 (FIG. 3A), a desirable trait for long lamp life.

Referring to the feedback loop of FIG. 3C, the set point $SP_3$ can be represented by the input signal to amplifier 352 and the following operations which produce $SP_3$, as follows:

$$SP_3=[K-(REG.\ V_B)(N_S/N_P)m]a \quad \text{(eq. 2)}$$

where

K is the set point $SP_2$, (REG. $V_B$)$(N_S/N_P)$m is the output of amplifier 352, described above, and a is the gain of amplifier 356.

With $SP_3$ as defined in equation 2, the average lamp current AVE. $I_L$ can be represented from the feedback loop of FIG. 3C as:

$$AVE.\ I_L=(SP_3+V_O)/H_2, \quad \text{(eq. 3)}$$

where

AVE. $I_L$ is average lamp current, $H_2$ is the conversion gain of current-to-voltage converter 330' (FIG. 3C), and $V_O$ is the offset voltage of summing amplifier 350, described above.

The power of lamp 300 (FIG. 3A) is assumed to meet the equation:

$$P_L=(AVE.\ I_L)(REG.\ V_B), \quad \text{(eq. 4)}$$

where $P_L$ is lamp power,

AVE. $I_L$ is the average lamp current $I_L$, and

REG. $V_B$ is the regulated bus voltage.

More generally, the average lamp current AVE. $I_L$ in equations 3 and 4 can be replaced by AVE. $I_B'$, where AVE. $I_B'$ at least approximates the average value of the bus current $I_B$.

Combining equations 3 and 4 to remove the term AVG. $I_L$ yields:

$$P_L=[(SP_3+V_O)/H_2](REG.\ V_B). \quad \text{(eq. 5)}$$

The regulated bus voltage REG. $V_B$ can be approximated as:

$$REG.\ V_B=(PEAK\ I_L)[(AVE.\ Z_L)+Z_D], \quad \text{(eq. 6)}$$

where

PEAK $I_L$ is the peak current in the lamp,

AVE. $Z_L$ is the average frequency-dependent impedance of lamp 300, and $Z_D$ is the impedance of lamp driver 308.

The peak current PEAK $I_L$ is defined from set point $SP_1$ (FIG. 3B) as:

$$PEAK\ I_L=(SP_1)/(H_2H_1), \quad \text{(eq. 7)}$$

where $H_2$ is the gain of current-to-voltage converter 330 (FIG. 3B), and $H_1$ is the gain of amplifier 332 (FIG. 3B).

Combining equations 5, 6 and 7 yields the following expression for lamp power in terms of lamp impedance and parameters of the feedback loops of FIGS. 3B and 3C:

$$P_L=[(SP_1)/(H_2^2H_1)][(AVE.\ Z_L)+Z_D](SP_2+V_O). \quad \text{(eq. 8)}$$

Combining equations 2, 6 and 7 yields the dynamic set point $SP_3$ (FIG. 3C) in terms of parameters of the feedback circuits of FIGS. 3B and 3C:

$$SP_3=\{K-[(SP_1)/(H_2H_1)][(AVE.\ Z_L)+Z_D]m(N_S/N_p)\}a, \quad \text{(eq. 9)}$$

where all term are defined above in connection with equations 2–7.

Equation 9 shows that the dynamic set point $SP_3$ is dependent on parameters of the feedback circuits of FIGS. 3B and 3C, which are typically constant, the driver impedance $Z_D$, also typically constant, and the lamp impedance $Z_L$, which changes considerably as a HPSL ages. Since the set point $SP_3$ changes with changes in lamp impedance, the invention compensates for considerable changes in lamp impedance. FIG. 5 graphically illustrates.

In FIG. 5, solid-line curve 500 is plotted in watts of power versus lamp impedance $Z_L$ in ohms. As a HPSL ages, its impedance $Z_L$ increases considerably. By compensating for considerable changes in lamp impedance $Z_L$, the invention achieves the rounded trajectory shown at 502, whereby the circuit powering the lamp is longer able to supply the needed power to operate the lamp. Without compensation for a large increase in lamp impedance $Z_L$, a lamp's power-versus-impedance curve has the continuing trajectory of dashed-line curve 504, and the lamp's power supply circuit more quickly becomes incapable of supplying the needed power to operate the lamp.

Error signal $E_2$, derived according to the foregoing analysis, is applied to lamp driver 308 (FIG. 3A), which may take the form as previously described in connection with FIG. 2A and the associated current waveforms of FIGS. 2B and 2C. A preferred, alternative embodiment of lamp driver 308 is shown in FIG. 4A.

In FIG. 4A, lamp driver 308 is configured with a pair of switches 450 and 452 whose on-off operation is complementary such that switch 450 is on while switch 452 is off, and vice versa. The lamp voltage $V_L$ and lamp current $I_L$ are plotted in FIG. 4B. Assuming the lamp voltage $V_L$ is initially zero, turning on switch 450 causes the regulated bus voltage REG. $V_B$ to be impressed across the series combination of a resonant inductor 454, lamp 300, and resonant capacitor 456, neglecting the low impedance of lamp current-sensing transformer 400. Since the lamp is extinguished at this time, the full regulated bus voltage REG. $V_B$ appears across the lamp, as indicated by the rapidly rising curve 480 in FIG. 4B. Such abrupt rise in lamp voltage $V_L$ forces a re-ignition of the lamp. This, in turn, initiates a lamp current having a resonant frequency primarily determined by the principal inductive and capacitive elements in the current path, which are resonant inductor 454 and parallel-connected resonant capacitors 456 and 458.

The resonating lamp current $I_L$ causes the lamp voltage $V_L$ to resonate towards 2(REG. $V_B$), until it is clamped to the sum of REG. $V_B$ and the voltage drop across one of diodes 460 and 462. This point corresponds to $\pi/2$ radians, or $\frac{1}{4}$ of the resonant cycle, where the lamp current (curve 482) reaches its maximum value. At this point, the resonant portion of the cycle has ended. The lamp voltage $V_L$ is clamped by one of diodes 460 and 462, and the energy stored in inductor 454 discharges as an exponential decay into the bus. Once the lamp current $I_L$ has decayed to zero, switch 450 can be turned off. Lamp driver 308 is now prepared to begin the cycle in the opposite direction because common node 465 between diodes 460 and 462 reaches the value of the regulated bus voltage REG. $V_B$. The amount of "dead time" is determined by the error signal $E_2$ and the responsive circuitry for controlling the on-off operation of switches 450 and 452, described below.

With the voltage on node 465 set at the sum of the regulated bus voltage REG. $V_B$ on one of capacitors 456 or 458, plus the voltage drop across one of diodes 460 and 462, switch 452 can be turned on. As with the previous cycle, the entire REG. $V_B$ is placed across lamp 300 until it re-ignites. Once this occurs, the lamp current begins to oscillate in the opposite direction of the described current flow through switch 450. During this time, the lamp voltage $V_L$ begins to resonate downward toward the negative value of the regulated bus voltage, −REG. $V_B$, until it is clamped at the negative voltage across one of diodes 460 and 462. At this point the forcing current is at its maximum negative value. As before, the process is the same, only the direction of current has changed.

Switches 450 and 452 are operated to achieve the waveforms of FIG. 4B in response to error signal $E_2$ received at pin 3 of IC 470 when embodied as a standard MC34066P chip, which is assumed in the following description. Error signal $E_2$ thereby controls the frequency of a signal on the primary winding 471 of a transformer 472, such primary winding 471 being connected and poled in the manner shown to output pins 12 and 14 of IC 470. Secondary winding 474 of transformer 472 is poled and connected to control the control the on-off operation of switch 450, which may be a FET. Where switch 450 is a FET, secondary winding 472 is connected across its gate and source terminals. Similarly, a further secondary winding 476 is poled and connected as shown to control switch 452, which may also be a FET. Because secondary windings 474 and 476 are oppositely poled, a positive waveform through the primary winding of transformer 472 turns on only one of the switches, and a negative waveform through the primary winding turns on only the other of the switches.

Further details of lamp driver circuit 308 are contained in the above cross-referenced application, attorney docket no. LD-10,203, the entire disclosure of which is incorporated herein by reference.

One possible circuit realization of the FIG. 4A circuit for a 95-watt HPSL 300 uses the following component values: inductance of transformer 406 in series with diode 412, 172 microhenries; capacitor 410, 470 microfarads; $N_S/N_P$ of transformer 406, 6/45; resonant inductor 454, 500 microhenries; resonant capacitors 456 and 458, each 4 microfarads; and ICs 402 and 470, the ICs identified by number above. Using such values, one possible implementation of the feedback loops of FIGS. 3B and 3C are as follows: gain $H_1$, 5.236; gain $H_2$, $80.65\times10^{-3}$; set point $SP_1$, 5.0; gain m, $95.3\times10^{-3}$; set point $SP_2$ (i.e. K), 5.477; gain a, $14\times10^{-3}$; and offset voltage $V_O$, 0.

From the foregoing, it can be seen that the invention provides compensation for considerable variance in lamp impedance while maintaining a nearly constant power level. It also provides a nearly constant amplitude of lamp current, and the ability to compensate for considerable variations of the a.c. line voltage. Further, these features may be attained with low cost, readily available circuit components.

While the invention has been described with respect to specific embodiments by way of illustration, many modifications and changes will occur to those skilled in the art. It is, therefore, to be understood that the appended claims are intended to cover all such modifications and changes as fall within the true spirit and scope of the invention.

What is claim is:

1. A circuit for powering a high intensity discharge lamp, comprising:

(a) means for supplying a d.c. bus voltage;

(b) first feedback-controlled means for regulating on a conductor supplying bus current the bus voltage in response to a first error signal in such manner as to minimize the first error signal, the first error signal being substantially proportional to the difference between (1) a dynamic peak current signal substantially proportional to peak lamp current and (2) a first set point signal for peak lamp current;

(c) second feedback-controlled means for driving said lamp with the regulated bus voltage in response to a second error signal in such manner as to minimize the second error signal and thereby regulate power in said lamp, the second error signal being substantially proportional to the difference between (1) a dynamic average current signal substantially proportional to average bus current and (2) a dynamic second set point signal substantially proportional to the difference between (i) a dynamic bus voltage signal substantially proportional to the regulated bus voltage and (ii) a third set point signal relating to lamp power; and, (d) wherein said second feedback-controlled means includes first and second current loops arranged to conduct current through said lamp in respective first and second opposite directions, first and second power switches for sequentially placing said lamp in alternate ones of said first and second current loops, and, said first and second current loops each including inductive and capacitive elements selected to cause respective first and second-loop current waveforms to each have a resonating portion mainly determined by the value of said inductive and capacitive elements.

2. The circuit of claim 1, wherein said second feedback-controlled means includes:

(a) a power switch connected to impress the regulated bus voltage across a series circuit including said lamp and an inductor when said switch is on and to isolate said series circuit from the regulated bus voltage when said switch is off; and (b) switch control means for repeatedly turning on and off said power switch in such manner as to minimize the second error signal.

3. The circuit of claim 2, wherein said second feedback-controlled means is configured such that the frequency of repeatedly turning on and off said power switch determines the length of an active portion of a constant-period duty cycle for driving said lamp.

4. The circuit of claim 2, wherein the first set point signal for peak lamp current is non-dynamic.

5. The circuit of claim 2, wherein the third set point signal relating to lamp power is non-dynamic.

6. The circuit of claim 2, wherein the dynamic average current signal substantially proportional to average bus current is derived from measuring current in said lamp.

7. The circuit of claim 1, wherein said first feedback-controlled means includes a buck-boost circuit with a switch whose on-off operation is controlled in response to the first error signal so as to minimize said signal.

8. The circuit of claim 7, wherein the dynamic average current signal substantially proportional to average bus current is derived from measuring current in said lamp.

9. The circuit of claim 1, wherein the first set point signal for peak lamp current is non-dynamic.

10. The circuit of claim 1, wherein the third set point signal relating to lamp power is non-dynamic.

11. The circuit of claim 1, wherein the dynamic average current signal substantially proportional to average bus current is derived from measuring current in said lamp.

12. A method of powering a high intensity discharge lamp, comprising the steps of:

supplying a d.c. bus voltage:

regulating the bus voltage in response to a first error signal in such manner as to minimize the first error signal, the first error signal being substantially proportional to the difference between (1) a dynamic peak current signal substantially proportional to peak lamp current and (2) a first set point signal for peak lamp current;

driving said lamp with the regulated bus voltage in response to a second error signal in such manner as to minimize the second error signal and thereby regulate power in said lamp, the second error signal being substantially proportional to the difference between (1) a dynamic average current signal substantially proportional to average bus current and (2) a dynamic second set point signal substantially proportional to the difference between (i) a dynamic bus voltage signal substantially proportional to the regulated bus voltage and (ii) a third set point signal relating to lamp power; and wherein the step of driving said lamp includes:

alternately impressing the regulated bus voltage across a series circuit including said lamp and an inductor and then isolating said series circuit from the regulated bus voltage; and controlling the frequency of alternate impressing and isolating said series circuit from the regulated bus voltage so as to minimize the second error signal.

13. The method of claim 12, wherein the step of controlling the frequency of alternate impressing and isolating said series circuit from the regulated bus voltage determines a frequency-responsive length of an active portion of a constant-period duty cycle for driving said lamp.

14. The method of claim 12, wherein the first set point signal for peak lamp current is non-dynamic.

15. The method of claim 12, wherein the third set point signal relating to lamp power is non-dynamic.

16. The method of claim 12, wherein the dynamic average current signal substantially proportional to average bus current is derived from measuring current in said lamp.

17. The method of claim 12, wherein the step of generating the regulated bus voltage comprises controlling the on-off operation of a buck-boost circuit whose output is the regulated bus voltage so as to minimize the first error signal.

18. The method of claim 17, wherein the dynamic signal substantially proportional to average bus current is derived from measuring current in said lamp.

19. The method of claim 12, wherein the step of driving said lamp includes sequentially placing said lamp in alternate ones of first and second current loops arranged to conduct current through said lamp in respective first and second opposite directions, said first and second current loops each including inductive and capacitive elements selected to cause respective first- and second-loop current waveforms to each have a resonating portion mainly determined by the value of said inductive and capacitive elements.

* * * * *